US006116133A

United States Patent [19]

Nishida

[11] Patent Number: 6,116,133

[45] Date of Patent: Sep. 12, 2000

[54] PUNCHER HEAD AND PUNCHER

[76] Inventor: Rikio Nishida, 840, Matsuyacho, Fushimi-ku, Kyoto-shi, Kyoto-fu, Japan

[21] Appl. No.: 09/286,674

[22] Filed: Apr. 6, 1999

[30] Foreign Application Priority Data

Apr. 7, 1998 [JP] Japan ..... 10-112690
Jul. 13, 1998 [JP] Japan ..... 10-214804

[51] Int. Cl.[7] ..... B26F 1/14

[52] U.S. Cl. ..... 83/686; 83/821

[58] Field of Search ..... 83/686, 685, 683, 83/821, 829; 30/361, 362, 363

[56] References Cited

U.S. PATENT DOCUMENTS

| | | | |
|---|---|---|---|
| 1,856,319 | 5/1932 | Cooper | 83/686 |
| 2,323,756 | 7/1943 | Smith | 83/686 |
| 3,209,575 | 10/1965 | Woodward, Jr. et al. | 83/686 |
| 3,463,042 | 8/1969 | Goldman | 83/685 |
| 3,465,634 | 9/1969 | Blais | 83/686 |
| 3,583,266 | 6/1971 | Kondo | 83/685 |
| 3,847,049 | 11/1974 | Bitzel | 83/821 |
| 4,022,089 | 5/1977 | Bulso, Jr. et al. | 83/685 |
| 4,281,546 | 8/1981 | Fraleigh | 73/864.44 |
| 4,495,699 | 1/1985 | Oakes | 30/361 |
| 4,509,396 | 4/1985 | Schall et al. | 83/685 |
| 5,603,882 | 2/1997 | Takano et al. | 83/685 |
| 5,722,139 | 3/1998 | Ladouceur et al. | 83/686 |
| 5,730,038 | 3/1998 | Evans et al. | 83/686 |
| 5,901,628 | 5/1999 | Sakamoto et al. | 83/685 |
| 5,943,934 | 8/1999 | Codatto | 83/686 |

FOREIGN PATENT DOCUMENTS

| | | | |
|---|---|---|---|
| 6438 | 12/1921 | Denmark | 30/363 |
| 230153 | 3/1893 | France | 30/363 |

*Primary Examiner*—M. Rachuba
*Assistant Examiner*—Omar Flores
*Attorney, Agent, or Firm*—Finnegan, Henderson, Farabow, Garrett & Dunner, L.L.P.

[57] ABSTRACT

A puncher head for punching an intended hole larger than a guide hole through a work piece, said puncher head having a punch and a die fitting thereto, and comprising a centering mechanism to guide the center of the draw-back shaft to the center of the guide hole. The puncher can cut out the intended hole exactly in an intended position.

7 Claims, 6 Drawing Sheets

PUNCHER HEAD AND PUNCHER

BACKGROUND OF THE INVENTION

1. Field of the Invention

The present invention relates to a puncher for punching holes through work pieces such as sheet and plate placed between a stationary member and a movable member and a puncher head to be used in the puncher.

2. Description of the Related Art

When an instrument board such as a switchboard, a distribution board or a control board is made to order, a ready-made box or case with no holes is worked to conform to individual needs. The ready-made case is not provided with holes for meters, breakers, switches etc. when it is delivered. The necessary holes have to be punched out for the instruments.

The usual process of making a hole on the face of a switchboard by a round puncher is this: The center of the hole is first marked by a center punch and then, with the tip of a drill placed at the mark, the drill is switched on to cut out a guide hole for the draw-back shaft of the puncher. The guide hole must be 2 to 3 mm larger than the draw-back shaft in diameter. If the guide hole is identical with the draw-back shaft in diameter, a doughnut-shaped cut-off scrap will adhere the draw-back shaft too hard to remove by hand after the punching work. For a draw-back shaft 10 mm in diameter, for example, a guide hole 13 mm in diameter is usually drilled.

But the problem is that it is difficult to punch an intended hole concentrically with the guide hole; the draw-back shaft tends to be eccentric with the guide hole, resulting in a deviation from the mark and a spoiled board. Even a 1 mm deviation would stand out especially on a board with a plurality of instruments mounted thereupon.

SUMMARY OF THE INVENTION

It is an object of the present invention to provide a puncher which can cut out an intended hole exactly in an intended position and a puncher head to be used in the puncher.

The object of the invention is attained by providing a puncher head for punching an intended hole larger than the guide hole through the work piece, the puncher head comprising a punch and a die fitting thereto, one of the two members being movable and the other member being stationary.

The steps of punching the intended hole comprises clamping the stationary member on a fluid pressure cylinder, putting the draw-back shaft of the cylinder into a guide hole of the work piece, mounting the movable member on the draw-back shaft and moving back and forth the movable member in relation to said stationary member, wherein there is provided a centering mechanism to bring the center of the draw-back shaft to that of the guide hole.

In the puncher head according to the present invention, the centering mechanism guides the draw-back shaft to the center of the guide hole, and there is no possibility that the center of the fitting area between the punch and the die will deviate from the center of the guide hole. That permits punching an intended hole exactly in an intended position and raises the quality and value of the finished product.

List of the Reference Numbers

Figure 1:
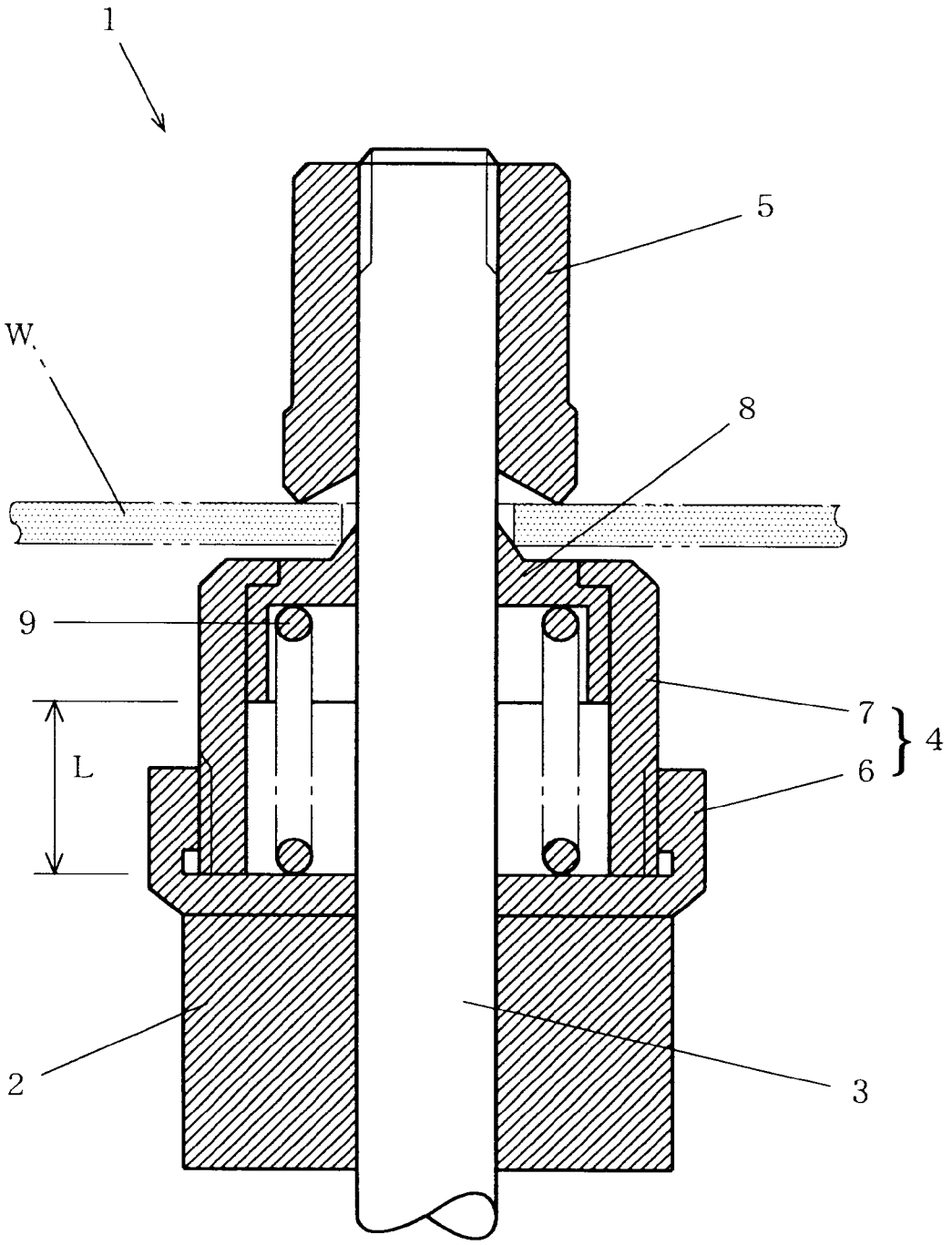
FIG. 1 is a longitudinal sectional view of the main part of a puncher ready for punching according to the first embodiment of the present invention.

1, 11, 21, 31 Puncher
2, 12, 22, 32 Cylinder
3, 13, 23, 33 Draw-back shaft
4, 14, 24, 34 Die
5, 15, 25, 35 Punch
6, 16, 26, 36 Joint part
7, 17, 27, 37 Blade part
8, 18, 28*a*, 38*a* Guide
28*b*, 38*b* Receptor
9, 19, 29 Spring
10, 30 Piston
39 Urethane rubber
20, 40 Return spring

DETAILED DESCRIPTION OF THE INVENTION

A preferred form of the centering mechanism comprises a guide having a projected end portion around the path of the draw-back shaft, the projected end portion gradually decreasing toward the punch in outside diameter. The guide is fitted in the cavity formed between the die and the draw-back shaft so that it can move back and forth while keeping concentric with the draw-back shaft. The guide is thrust toward the punch by an elastic force until the projected end portion usually protrudes above the die but forced back concentrically with the draw-back shaft as the punch fits thereupon.

The guide has a projected end portion around the path of the draw-back shaft, the projected end portion gradually decreasing toward the punch in outside diameter and, in the steady position, sits with the projected end portion protruding above the die. As the work piece is held between the movable member and the stationary member after the draw-back shaft is put through the guide hole of the work piece and the movable member is put in place, the projected end portion protruding above the die is thrust into the annular space between the guide hole and the draw-back shaft, guiding the center of the draw-back shaft into the center of the guide hole.

As the pressure is increased with the draw-back shaft put in place in the guide hole to pull in the draw-back shaft, the movable member moves toward the stationary member, applying a shearing force on the work piece and cutting out the intended hole. The guide is thrust by the punch into the die together with the cut-off scrap. Then, the cylinder pressure is released and the elastic force thrusts back the guide into the steady position, pushing out the cut-off scrap. The means for elastically thrusting the guide is not restrictive in particular. A spring, for example, is preferred, but urethane rubber serves the purpose.

Another preferred form of the centering mechanism is a guide formed integrally within the punch blade unlike the above-mentioned guide. In this preferred form, the guide protrudes past the blade with its projected end portion around the path of the draw-back shaft decreasing toward the die in outside diameter. As the work piece is held between the movable member and the stationary member after the draw-back shaft is put through the guide hole of the work piece and the moving member is put in place, the projected end portion protruding past the blade is thrust into the annular space between the guide hole and the draw-back shaft, guiding the center of the draw-back shaft into the center of the guide hole.

With the centering mechanism with the guide provided on the punch, there is ideally provided a receptor to push out the cut-off scrap and means to elastically thrust the receptor toward the punch. The receptor is fitted in the cavity formed between the die and the draw-back shaft so that it can move back and forth, and has a fore end portion not projecting above the die. As the cylinder pressure is released, the elastic force thrusts back the receptor into the original position, pushing out the cut-off scrap. As in the first preferred form of the centering mechanism, urethane rubber or spring can be used to generate elastic force.

In working with the usual puncher head, the draw-back shaft in the fluid pressure cylinder is put through the stationary member and the work piece and then mounted with the movable member. This way, the stationary member, the work piece and the movable member are clamped. Therefore, the stationary member as well as the movable member does not have to be integrated with the fluid pressure cylinder in a set or unit or have to be special for a specific fluid pressure cylinder. That is, the puncher head according to the present invention can take forms which allow it to be traded independently of the fluid pressure cylinder as long as it is arranged as set forth above.

Meanwhile, the present invention is also a puncher comprising a fluid pressure cylinder and the aforesaid puncher head. In this case, the fluid pressure cylinder and the stationary member always have to be of integral construction, or the stationary member has to be so formed as to be special for a specific fluid pressure cylinder. But the elastic force of the return spring in the cylinder piston can be utilized to thrust the aforesaid guide or receptor.

DESCRIPTION OF THE PREFERRED EMBODIMENTS

Actual Embodiment 1

An embodiment of the present invention will now be described with reference to the drawings. FIG. 1 is a longitudinal sectional view of the main part of a puncher ready for punching according to the first embodiment of the present invention.

A puncher 1 is provided with a draw-back shaft 3 to be pulled back by pressure of a cylinder 2 of a hydraulic pump (not shown). A die 4 is fitted into a draw-back shaft 3 which is extending over the top of the cylinder 2. On the upper end of the draw-back shaft is a screwed and clamped punch. The die 4 comprises two members—a joint part 6 supported on the end face of the cylinder 2 and a cylindrical blade part 7 which is screwed and fitted therein concentrically with the draw-back shaft 3. The blade part 7 is narrowed at the upper end alone until the inside diameter is almost the same as the outside diameter of the punch 5; the other part is uniformly larger than the outside diameter of the punch 5.

Inside the cavity formed between the die 4 and the draw-back shaft 3 is provided a centering mechanism comprising a guide 8 and a coil spring 9. The guide 8 is cylindrical in shape having two portions different from each other in diameter, the outside wall sliding along the inside wall of the blade part 7 and the inside wall at the fore end portion (the end portion facing the punch) sliding along the draw-back shaft. The difference L between the longitudinal length of the blade part 7 and that of the outside sliding wall of the guide 8 is made larger than the stroke of the piston in the cylinder 2. The spring 9 is provided around the inside wall other than the fore end portion of the guide 8 so as to thrust the guide 8 toward the punch 5. The outside wall of the guide 8 is differentiated in outside diameter to create a shoulder so that the guide 8 stops and sits in a steady position with the shoulder under the fore end portion of the die 4. The outside diameter of the projected end portion of the guide 8 decreases toward the end point.

As set forth above, the punch 5, the die 4, the guide 8 and the spring 9 make up a puncher head. This puncher head is clamped just by fitting into the draw-back shaft 3 and is not exclusive to a specific cylinder but can be combined with a variety of cylinders.

Now, there will be explained the operation of making a hole on a work piece using this puncher 1. First, the work piece is marked at the center of an intended hole by the center punch. With the tip of the drill blade placed at the mark, the power drill is switched on to make a hole some 3 mm larger than the outside diameter of the draw-back shaft 3. For a draw-back shaft 3 with an outside diameter of 10 mm, the guide hole should be 13 mm in diameter. The steps of the operation up to this point are the same as with the prior art puncher.

Figure 2:
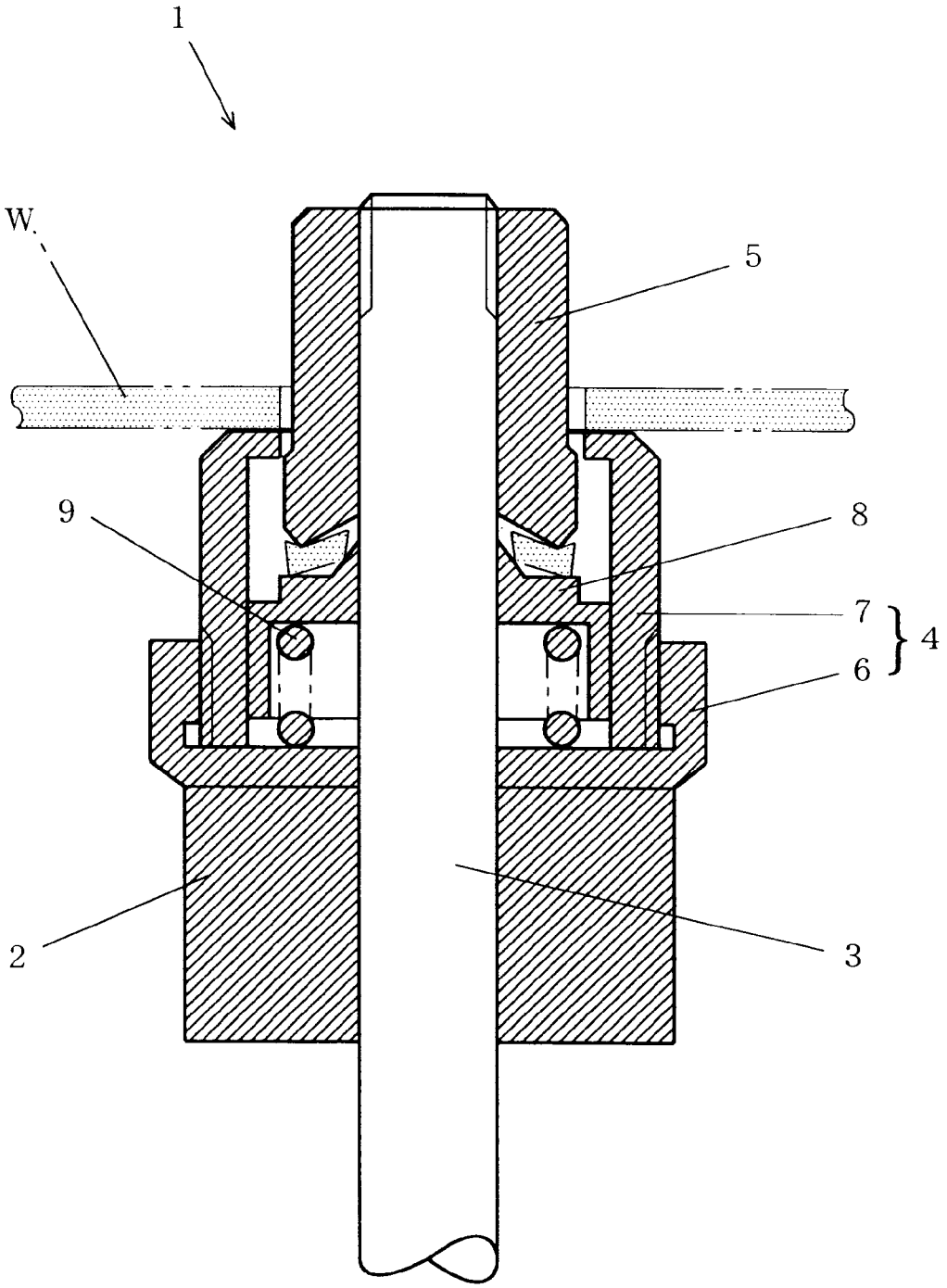
FIG. 2 is a longitudinal sectional view of the main part of a puncher after punching according to the first embodiment of the present invention.

The draw-back shaft 3 mounted with the die 4 is put through the guide hole and then the punch 5 is screwed in. The projected end portion of the guide 8 is forced into the annular space formed between the draw-back shaft 3 and the guide hole to hold the draw-back shaft 3 in position. The guide 8 which can draw back will be forced back by the work piece W if the center of the shaft is not in agreement with that of the guide hole. When the center of the shaft tallies with that of the guide hole, the guide is thrust by the spring 9 into the annular space. Thus, after the punch is mounted, the center of the draw-back shaft 3 can be brought to the center of the guide hole just by slightly moving the draw-back shaft 3 and this state can be held. Then, the pressure of the cylinder 2 is raised to pull the draw-back shaft 3, and the draw-back shaft 3 recedes with the punch while keeping concentric with the guide hole as illustrated in FIG. 2. And the punch 5 applies a shearing force on the work piece W in cooperation with the die 4. As the work piece W is being punched out, the guide 8, too, is forced backward against the elastic force of the spring 9. Since the stroke of the piston in the cylinder 2 is shorter than L, the back end face of the guide 8 does not hit the bottom of the joint part 6.

After the intended hole is punched out and the pressure in the cylinder 2 is released, the guide 8 is brought back to the original steady position by the restoring force of the spring 9 and at the same time the doughnut-shaped cut-off scrap is pushed out on the guide 8. Therefore, when the punch 5 is taken off, the cut-off scrap can be removed by hand without difficulty. The intended hole is punched exactly right in the marked position.

In the present embodiment, the die 4 is the stationary member and the punch 3 is the movable member. That can be reversed. The same is applicable to other embodiments which will be described hereinafter.

Actual Embodiment 2

Figure 3:
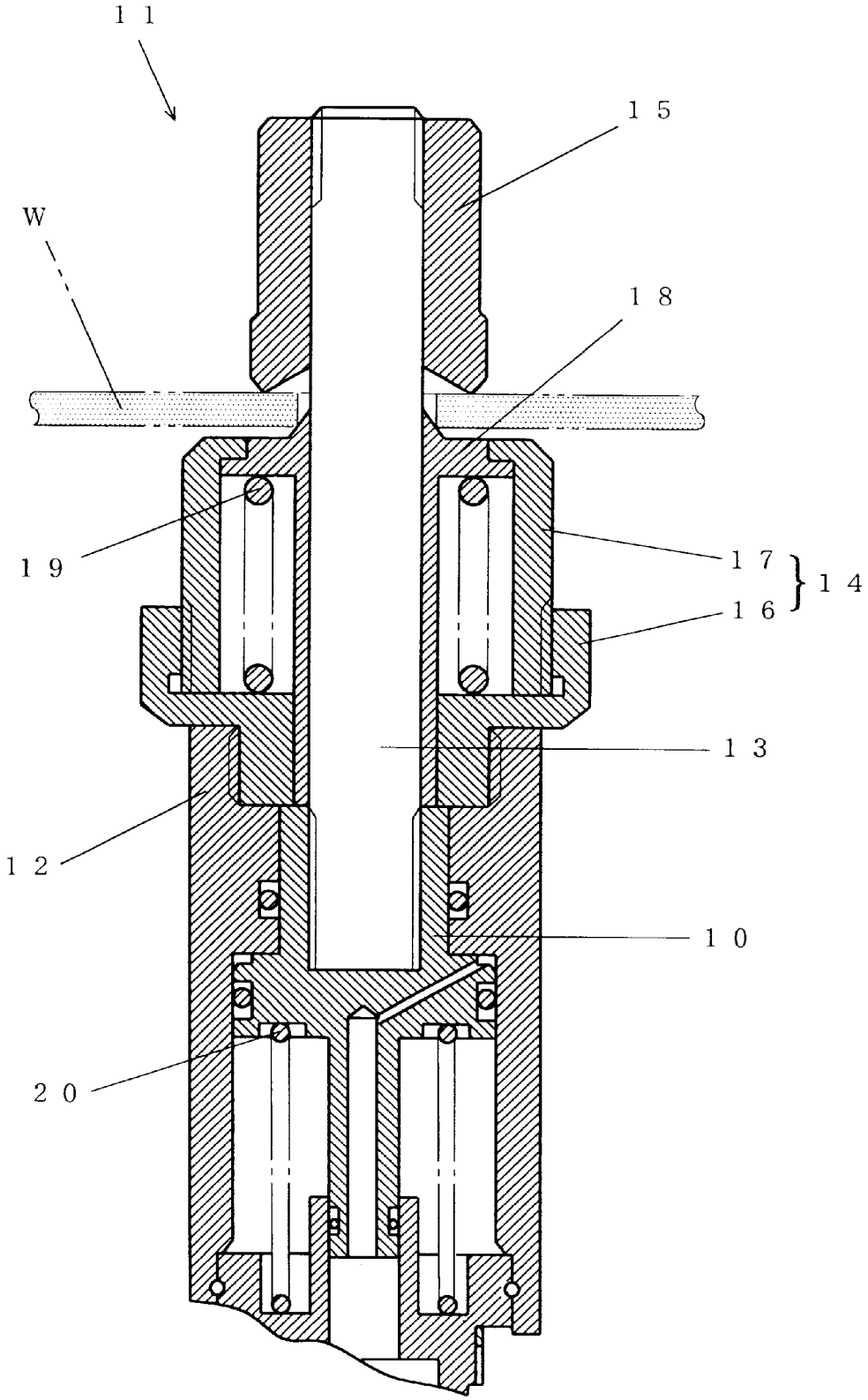
FIG. 3 is a longitudinal sectional view of the main part of a puncher ready for punching according to the second embodiment of the present invention.

In the first embodiment, the restoration of the guide to the steady position and the removal of the cut-off scrap are effected by the elastic force of the spring provided inside the die. In the second embodiment, the elastic force is produced by the spring inside the die and the return spring of the cylinder piston as well. The second embodiment will now be described with reference to FIG. 3.

Figure 4:
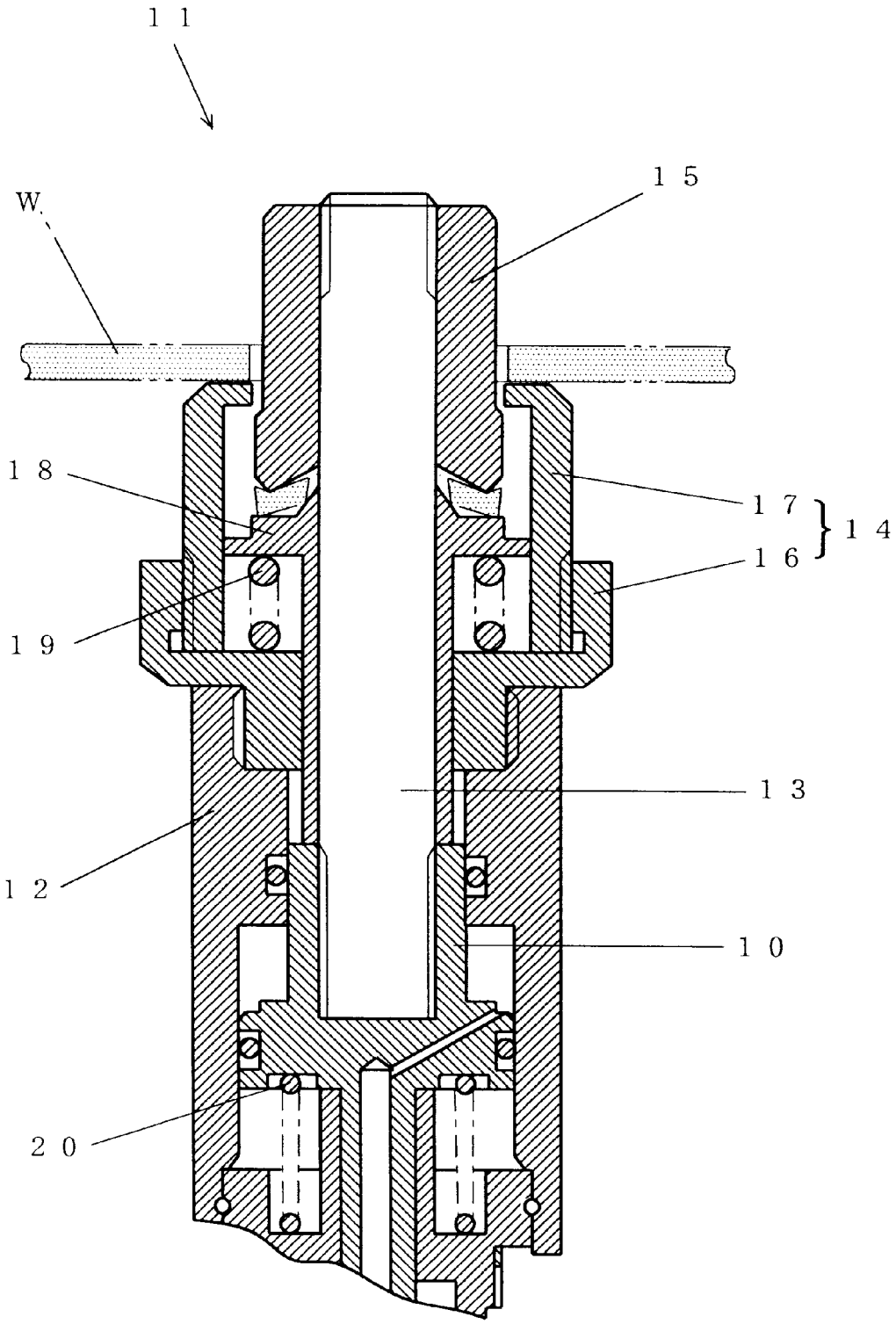
FIG. 4 is a longitudinal sectional view of the main part of a puncher after punching according to the second embodiment of the present invention.

A puncher 11 in the present embodiment can use the same type punch 15 and die 14 as those in the first embodiment. A guide 18 is mushroom-shaped as a whole with a shaft hole that extends from the top to the back end along which a draw-back shaft 13 slides. Unlike in the first embodiment, a coil spring 19 to thrust the guide 18 is provided in a cavity formed between the guide 18 and the blade part 17 of the die 14. The draw-back shaft 13 is screwed into a recess formed at the fore end portion of the piston 10, and the back end face of the guide 18 extends up to the back end face of the joint part 16 and comes in contact with the fore end face of the piston 10 as illustrated in FIG. 4. After the punching operation by the punch 15 and the die 14 is over and the pressure in the cylinder is released, therefore, the restoring force of the return spring 20 inside the cylinder is conveyed to the guide 20 via the fore end face of the piston 10.

In the puncher of the construction according to the present embodiment, therefore, the cut-off scrap adhering the draw-back shaft 13 so hard to push off by the elastic force of the coil spring 19 alone can be forced out without difficulty as the elastic restoring force of the return spring 20 to bring back the piston 10 to the steady position can be added to the back end of the guide 18.

Actual Embodiment 3

Figure 5:
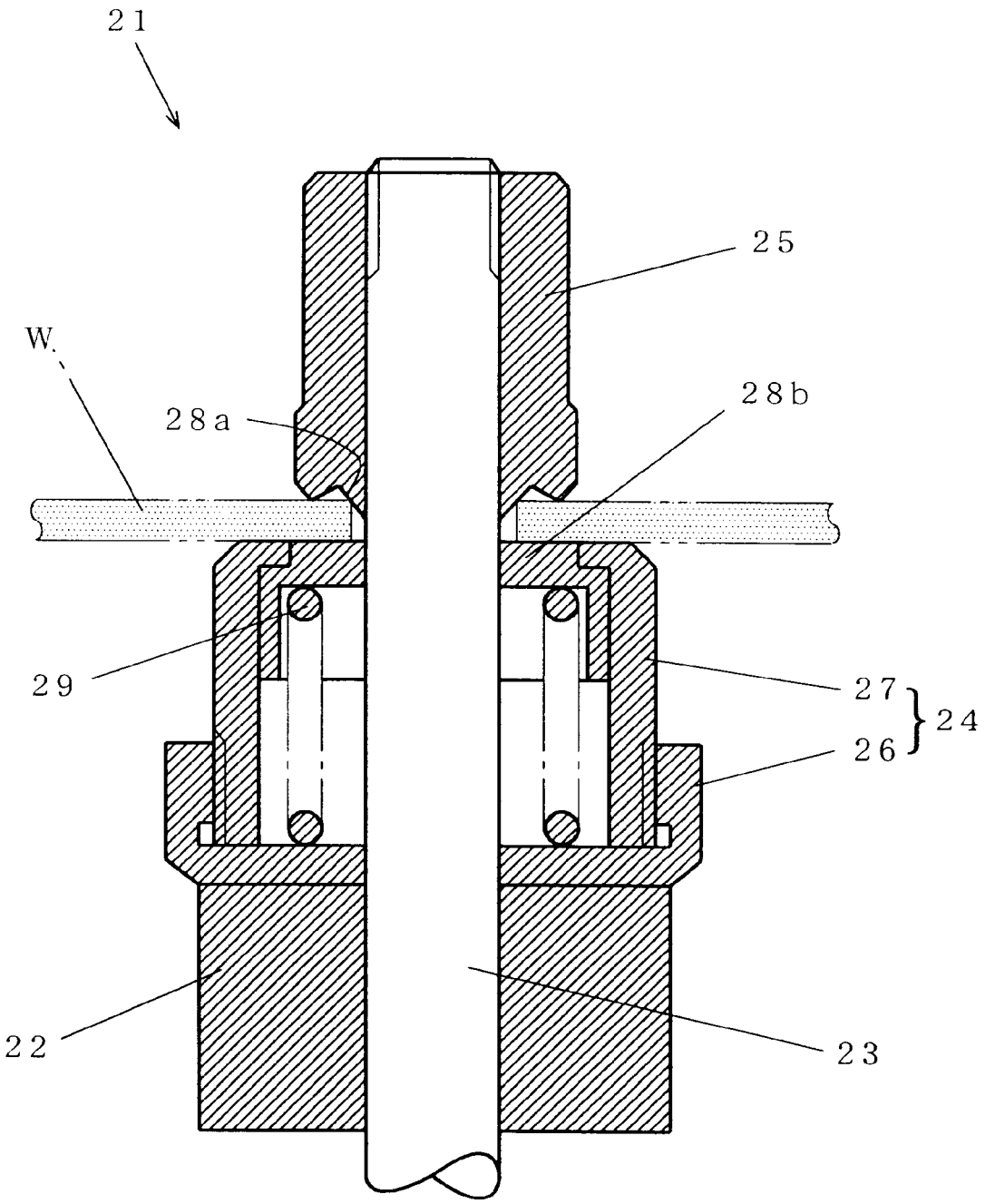
FIG. 5 is a longitudinal sectional view of the main part of a puncher according to the third embodiment of the present invention.

Unlike in the aforesaid two embodiments, a guide is provided on the punch. As shown in FIG. 5, the punch 25 of a puncher 21 has a guide 28*a* inside the blade, the punch and the guide formed in a single piece. The guide 28*a* protrudes past the blade and decreases toward the die 24 in outside diameter. In the cavity between the die 24 and the draw-back shaft 23 is fitted a receptor 28*b* which is identical with the guide 8 in Embodiment 1 except for the projected end portion and is thrust up by a spring 29.

In this embodiment, when the draw-back shaft 23 is put into the guide hole and the punch 25 is mounted to hold the work piece between the punch 25 and the die 24, the projected end portion of the guide 28*a* extending from the blade of the punch 25 is forced into the annular space formed between the guide hole and the draw-back shaft 23, bringing the center of the draw-back shaft 23 to the center of the guide hole. The punching operation is the same as in Embodiment 1.

After the intended hole is punched and the pressure in the cylinder 2 is released, the elastic force of the spring 29 thrusts back the receptor 28*b* and forces out the cut-off scrap.

Actual Embodiment 4

Figure 6:
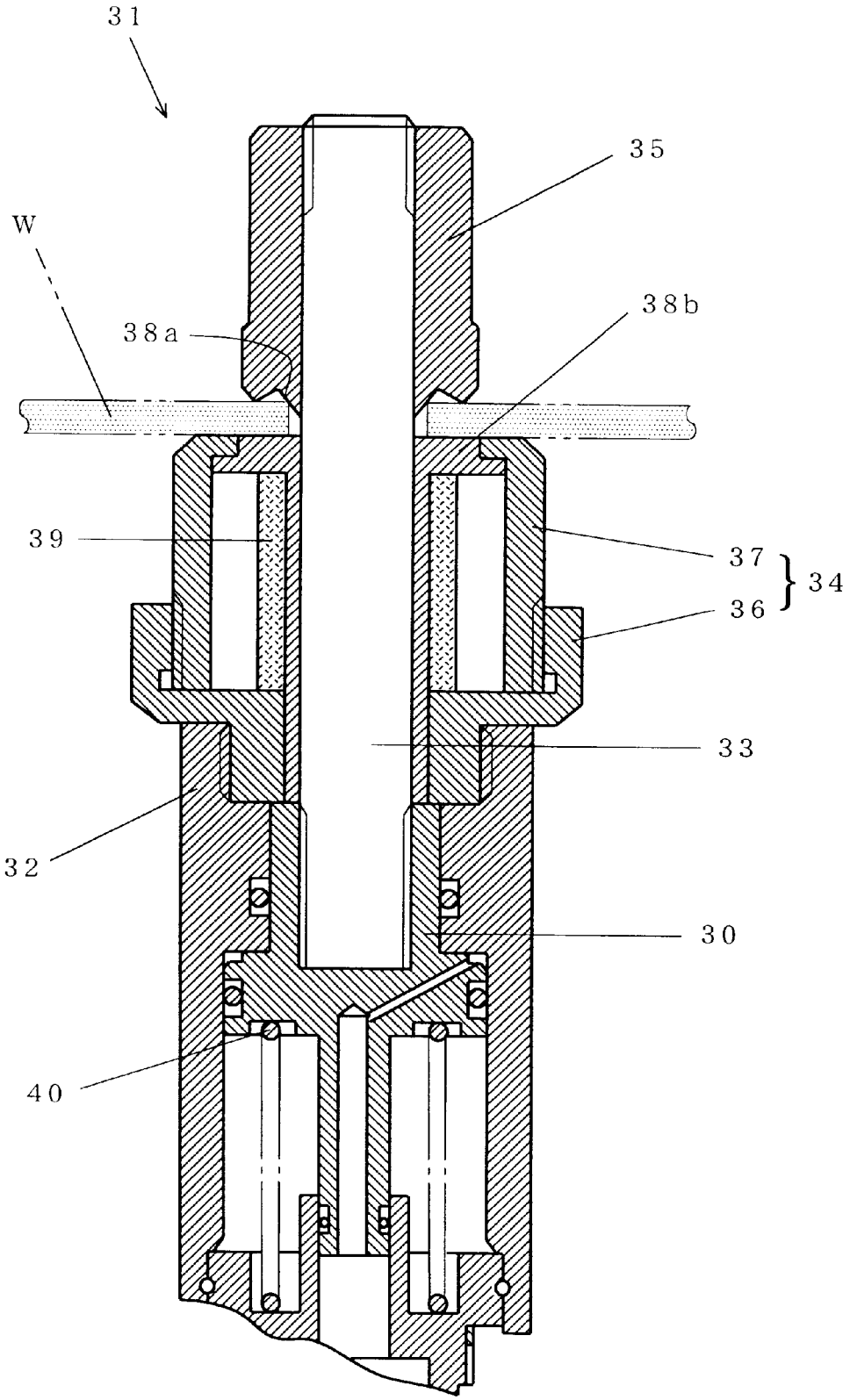
FIG. 6 is a longitudinal sectional view of the main part of a puncher according to the fourth embodiment of the present invention.

Unlike in the second embodiment, urethane rubber 39 is used to generate an elastic force to thrust a receptor 38*b* in this embodiment as shown in FIG. 6. A guide 38*a* is provided inside the blade of a punch 35, the guide and the punch formed in a single piece as in the third embodiment. The present embodiment is identical with the second embodiment in other points.

What is claimed is:

1. A puncher head for punching a hole larger than a guide hole through a work piece, said puncher head having punch and die members, one of said punch and die members being stationary and the other being movable relative to the work piece, and a draw-back shaft for connecting the punch and die members and extendable through the guide hole of the work piece, said puncher head comprising:

a tapered centering mechanism engagable with the guide hole to guide the draw-back shaft into concentricity with the guide hole.

2. A puncher head for punching a hole larger than a guide hole through a work piece, said puncher head having punch and die members, one of said punch and die members being stationary and the other being movable relative to the work piece, and a draw-back shaft for connecting the punch and die members and extendable through the guide hole of the work piece, said puncher head comprising:

a tapered centering mechanism to guide the draw-back shaft to the center of the guide hole and comprising:

a guide having a projected end portion around the draw-back shaft, said projected end portion having an outside diameter gradually decreasing toward the punch, said guide being fitted in a cavity formed between the die member and the draw-back shaft so that said guide can move back and forth while remaining concentric with the draw-back shaft; and means for elastically thrusting the guide toward the punch.

3. A puncher head as defined in claim 2, wherein the means for elastically thrusting said guide is a spring.

4. A puncher head for punching a hole larger than a guide hole through a work piece, said puncher head having punch and die members, one of said punch and die members being stationary and the other being movable relative to the work piece, and a draw-back shaft for connecting the punch and die members and extendable through the guide hole of the work piece, said puncher head comprising a tapered centering mechanism to guide the draw-back shaft to the center of the guide hole, wherein the punch member has a blade and said centering mechanism comprises a guide having a projected end portion and formed inside the blade of the punch member and around the draw-back shaft, said guide and said punch member being formed in a single piece, the projected end portion of said guide protruding past the blade and having an outside diameter gradually decreasing toward the die.

5. A puncher head as defined in claim 4, wherein said centering mechanism further comprises;

a receptor fitted in a cavity formed between the die member and the draw-back shaft to be movable back and forth, said receptor having a fore end portion positioned within a cutting edge portion of the die member; and means for elastically thrusting said receptor toward the punch.

6. A puncher head as defined in claim 5, wherein the means for elastically thrusting the receptor is a spring.

7. A puncher head as defined in any one of claims 1–6 including a fluid pressure cylinder for moving one of the punch and die members relative to the other of said members.

* * * * *